US007766005B2

(12) United States Patent
Lee et al.

(10) Patent No.: US 7,766,005 B2
(45) Date of Patent: Aug. 3, 2010

(54) GAS RADIATION BURNER AND CONTROLLING METHOD THEREOF

(75) Inventors: Dae Rae Lee, Gimhae-si (KR); Jung Wan Ryu, Changwon-si (KR); Dae Bong Yang, Jinhae-si (KR); Young Soo Kim, Changwon-si (KR); Yang Ho Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 143 days.

(21) Appl. No.: 11/655,166

(22) Filed: Jan. 19, 2007

(65) Prior Publication Data

US 2007/0207430 A1 Sep. 6, 2007

(30) Foreign Application Priority Data

Jan. 20, 2006 (KR) ..... 10-2006-0006367
Jan. 20, 2006 (KR) ..... 10-2006-0006399

(51) Int. Cl.
*F24C 3/00* (2006.01)

(52) U.S. Cl. ..... 126/39 J; 126/15 A; 126/39 H; 126/39 N; 126/39 K

(58) Field of Classification Search ..... 126/39 J, 126/15 A, 39 H, 39 N, 39 K
See application file for complete search history.

(56) References Cited

U.S. PATENT DOCUMENTS 2,870,830 A * 1/1959 Revision Treu Rheinisch-Westfa et al. ..... 239/590
3,785,364 A * 1/1974 Reid et al. ..... 126/39 J
4,020,821 A * 5/1977 Reid et al. ..... 126/39 E
4,083,355 A * 4/1978 Schwank ..... 126/39 J
4,201,184 A * 5/1980 Scheidler et al. ..... 126/39 J
4,580,550 A * 4/1986 Kristen et al. ..... 126/39 J
4,850,264 A * 7/1989 Kiser ..... 454/255
4,887,958 A * 12/1989 Hagar ..... 431/12
4,913,128 A * 4/1990 Adachi ..... 122/14.21
4,960,041 A * 10/1990 Kiser ..... 454/238
5,024,209 A * 6/1991 Schaupert ..... 126/39 H
5,090,899 A * 2/1992 Kee ..... 431/326
5,139,007 A * 8/1992 Bertomeu Martinez .... 126/39 J
5,251,609 A * 10/1993 Thibault et al. ..... 126/39 J
5,259,361 A * 11/1993 LeStrat et al. ..... 126/39 J
5,375,996 A * 12/1994 Nakamura et al. ..... 431/115
5,509,403 A * 4/1996 Kahlke et al. ..... 126/39 E
6,076,517 A * 6/2000 Kahlke et al. ..... 126/39 J
6,349,714 B1 * 2/2002 Hurley et al. ..... 126/39 J
6,508,245 B2 * 1/2003 Taplan ..... 126/39 R (Continued)

FOREIGN PATENT DOCUMENTS

CN 2037035 U 5/1989

(Continued)

*Primary Examiner*—Kenneth B Rinehart
*Assistant Examiner*—Jorge Pereiro
(74) *Attorney, Agent, or Firm*—Birch, Stewart, Kolasch & Birch, LLP

(57) ABSTRACT

A gas radiation burner includes a gas supply unit for spraying a mixed gas of a gas and air; a burner body having a burner pot accommodating the mixed gas supplied by the gas supply unit and a burner housing provided on the burner pot to configure a combustion chamber; a burner mat provided over the burner pot to emit a radiant heat generated by combustion of the mixed gas supplied by the burner pot; and an air supply unit supplying air to the burner housing.

21 Claims, 9 Drawing Sheets

U.S. PATENT DOCUMENTS

| | | | | |
|---|---|---|---|---|
| 6,609,513 | B2 * | 8/2003 | Yamada et al. | 126/39 J |
| 6,823,859 | B2 * | 11/2004 | Yamada et al. | 126/39 J |
| 6,966,315 | B2 * | 11/2005 | Pickering | 126/39 E |
| 2005/0142509 | A1 * | 6/2005 | Kim et al. | 431/127 |
| 2005/0287253 | A1 * | 12/2005 | Bucher et al. | 426/231 |

FOREIGN PATENT DOCUMENTS

| | | | |
|---|---|---|---|
| CN | 1065609 | C | 5/2001 |
| CN | 1081316 | C | 3/2002 |
| DE | 3811477 | A1 * | 10/1988 |
| JP | 62-155428 | A | 7/1987 |
| JP | 03639399 | B2 | 1/2005 |
| KR | 2002-0009657 | A | 2/2002 |
| KR | 2003-0044768 | A | 6/2003 |
| KR | 10-2005-0051244 | A | 6/2005 |
| KR | 10-0516626 | B1 | 8/2005 |

* cited by examiner

GAS RADIATION BURNER AND CONTROLLING METHOD THEREOF

This Nonprovisional application claims priority under 35 U.S.C. §119(a) on Patent Application No. 10-2006-0006367 filed in Korea on Jan. 20, 2006 and Patent Application No. 10-2006-0006399 filed in Korea on Jan. 20, 2006, the entire contents of which are hereby incorporated by reference.

BACKGROUND OF THE INVENTION

1. Field of the Invention

The present invention relates to a gas radiation burner, and more particularly, to a gas radiation burner and a controlling method thereof. Although the present invention is suitable for a wide scope of applications, it is particularly suitable for supplying air sufficiently to accelerate combustion.

2. Discussion of the Related Art

Generally, a gas radiation burner provided to a gas oven or range is a device for cooking in a manner of heating an object by radiant waves. In this case, the radiant waves are generated from a radiant body that is heated as a mixed gas burns. This mixed gas includes gas and air.

In particular, since a glass is placed over the gas radiation burner, the glass can prevent the flame from being externally exposed. Therefore, a fire accident can be prevented. In addition, the gas radiation burner facilitates cleaning to enhance its convenience for use.

An example of a gas radiation burner 10 according to a related art is explained in detail with reference to FIG. 1 as follows.

FIG. 1 is a cross-sectional diagram of a gas radiation burner according to a related art.

Referring to FIG. 1, a gas radiation burner according to a related art mainly includes a mixing pipe 2, a burner body 7 having a burner pot 4 and a burner housing 8, a burner mat 6, and a glass 10.

The mixing pipe 2 provides a space into which a gas fuel and air are introduced to be primarily mixed. In this case, the gas fuel is sprayed from a nozzle 1 that configures a gas supply member. In addition, the air is introduced into the mixing pipe 2 by a spray pressure of the gas fuel to be mixed therein.

The burner pot 4 is connected to the mixing pipe 2 via its bottom to provide a space, into which the mixed gas supplied from the mixing pipe 2 is introduced to be burnt therein. Therefore, the gas fuel and air included in the mixed gas introduced from the mixing pipe 2 are mixed together more uniformly.

The burner mat 6 is mounted on a mounting part 5 provided over the burner pot 4. The burner mat 6 plays a role as a radiant body that generates radiant waves when the mixed gas introduced into the burner pot 4 burns.

The burner housing 8 plays a role as a body of the gas radiation burner. The burner pot 4 is locked to the burner housing 8. An object to be heated is placed on the burner housing 8. In this case, the burner housing 8 is provided with a circular opening 9 through which radiant energy emitted from the burner mat 6 passes.

In addition, the glass 10 is placed on the burner housing 8. The object to be heated is placed onto the glass 10. Besides, an outlet 11 is provided within the burner housing 8. Therefore, an exhaust gas produced from burning the mixed gas is discharged via the outlet 11.

An operation of the above-configured gas radiation burner is explained as follows.

First of all, a user puts an object to be heated onto the glass 10 and then activates the gas radiation burner.

Subsequently, a gas fuel and air are introduced into the mixing pipe 2 respectively. The introduced gas fuel and air are supplied to the burner pot 5 and mixed together therein. The mixed gas is then sprayed via the burner mat 6.

Simultaneously, the mixed gas is ignited by a prescribed ignition means (not shown in the drawings) and is then burnt on the burner mat 6. As the mixed gas is burnt, the burner mat 6 is heated to emit radiant energy. Therefore, the object put on the glass 10 is heated by the generated radiant energy.

In this case, an exhaust gas generated from the combustion of the mixed gas at about 500° C. or higher is discharged via the outlet 11 provided within the burner housing 8.

However, the related art gas radiation burner has the following problems.

First of all, in the related art gas radiation burner, when the gas fuel is supplied to the burner pot, air necessary for combustion is supplied by a pressure difference around the gas fuel. In particular, if the gas is sprayed into the mixing pipe from the nozzle, a flowing speed of the gas fuel introduced into the mixing pipe is considerably high. Therefore, a low pressure is generated around the gas fuel. In this case, the air in a static state around the nozzle has a relatively high pressure to be sucked into the mixing pipe by the fluid pressure difference.

Yet, since the air is supplied by the air pressure difference only in the related art gas radiation burner, it is unable to supply the air sufficiently in case that a considerable amount of heat is needed. Therefore, incomplete combustion takes place in the burner body to reduce combustion efficiency and increase exhaust gas containing carbon monoxide (CO) injurious to human health.

Secondly, since the air introduced into the burner body is supplied only if the fuel is introduced into the burner body, after the fuel combustion ends, the mixed gas of the fuel and air within the burner body still remain. The mixed gas remaining within the burner body becomes ignited abruptly in case of re-ignition of the burner, which may lead to an explosion. Hence, the safety of the burner is not guaranteed.

Thirdly, even if the fuel combustion is terminated in the related art gas radiation burner, since the burner mat provided to the burner body keeps emitting radiant heat, the temperature of the glass on the burner body keeps rising. Hence, the object to be heated on the glass is overheated and a room temperature rises.

SUMMARY OF THE INVENTION

Accordingly, the present invention is directed to a gas radiation burner and a controlling method thereof that substantially obviate one or more problems due to limitations and disadvantages of the related art.

An object of the present invention is to provide a gas radiation burner and a controlling method thereof, thereby achieving better combustion by supplying air to the gas radiation burner sufficiently.

Another object of the present invention is to provide a gas radiation burner and controlling method thereof, by which safety in using the gas radiation burner can be enhanced.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a gas radiation burner includes a gas supply unit for spraying a mixed gas of a gas and air; a burner body having a burner pot accommodating the mixed gas supplied by the gas supply unit and a burner housing provided on the burner pot to configure a combustion chamber; a burner mat provided over the burner pot to emit a radiant heat generated by combustion of the mixed gas supplied by the burner pot; and an air supply unit supplying air to the burner housing In another aspect of the present invention, a method of controlling a gas radiation burner includes supplying a mixed gas of air and a gas to a burner body according to a required heat quantity for the gas radiation burner; heating an object by combustion of the mixed gas; and supplying air to the burner body after the combustion to prevent the burner body from being overheated.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE ILLUSTRATED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

First of all, a gas oven or range employing a gas radiation burner according to an embodiment of the present invention is explained with reference to FIG. 2. In this case, FIG. 2 shows an example of a built-in type gas oven or range.

Figure 1:
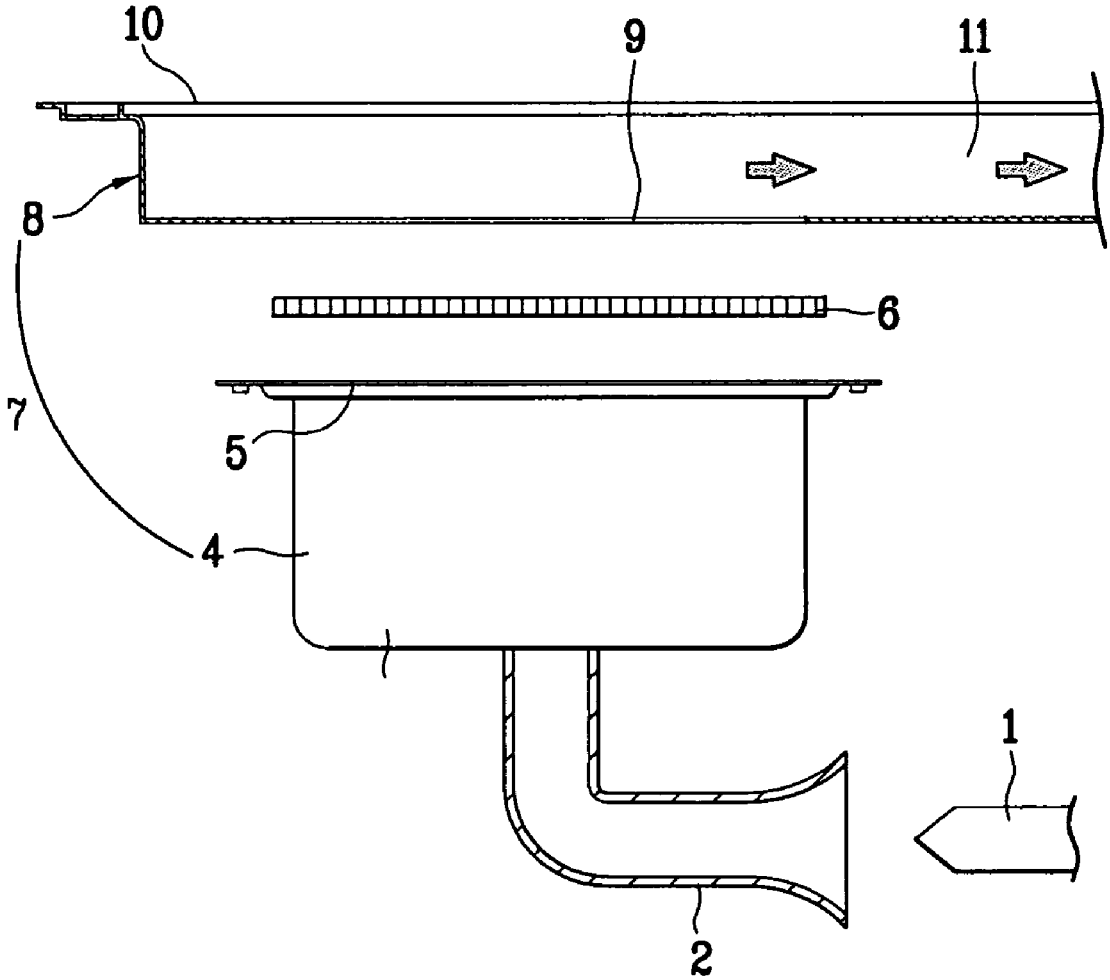
FIG. 1 Related Art
FIG. 1 is a cross-sectional diagram of a gas radiation burner according to a related art.
Figure 2:
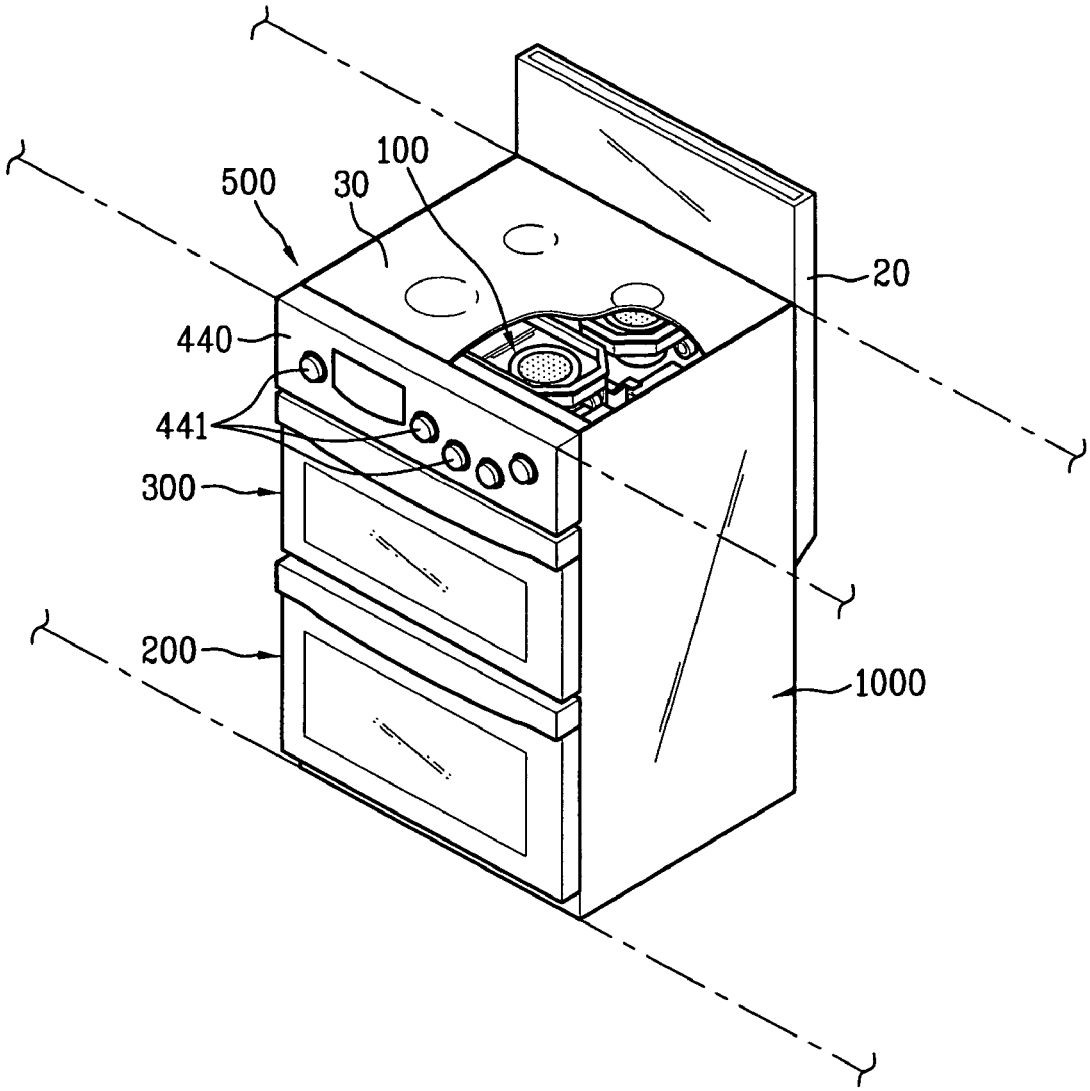
FIG. 2 is a perspective diagram of a gas oven having a gas radiation burner according to a preferred embodiment of the present invention.

Referring to FIG. 2, a gas oven or range includes a body 1000, an oven part 200, a grill part 300 and a top burner part 500 including a plurality of gas radiation burners 100.

The body 1000 configures an exterior of the gas oven or range. The oven part 200 is provided to a lower part of the body 1000 and configures a space for cooking food by convection current heat of a plurality of heaters (not shown in the drawing) provided within the oven part 200. In addition, the grill part 300 configures a space for cooking food such as fish, meat and the like using radiant heat.

A plurality of the gas radiation burners 100 are provided to an upper part of the body 1000 to cook food by heating a container accommodating the food therein. In addition, a glass 30 normally formed of a ceramic based material is provided to an opening over the corresponding gas radiation burner 100. The glass 30 includes heat-resistant glass having a small heat-expansion coefficient and resistant against an abrupt temperature change. Optionally, a temperature sensor detecting a temperature of the glass 30 can be provided to a bottom of the glass 30.

An air inlet 13 (shown in FIG. 3) is provided to the body 100 so that air can be sucked via the air inlet 13. In addition, the air inlet 13 communicates with an external environment of the gas radiation burner.

Meanwhile, a control panel 440 including a plurality of buttons 441 to control the gas radiation burner 100 is installed at a front side of the body 1000.

In case that the gas radiation burner is installed as a built-in type, the body 1000 is preferably installed to have a same height of another home appliance. Besides, there is an exhaust duct 20 at the rear side of the body 1000.

A configuration of a gas radiation burner according to an embodiment of the present invention is explained in detail with reference to FIG. 3 as follows.

Figure 3:
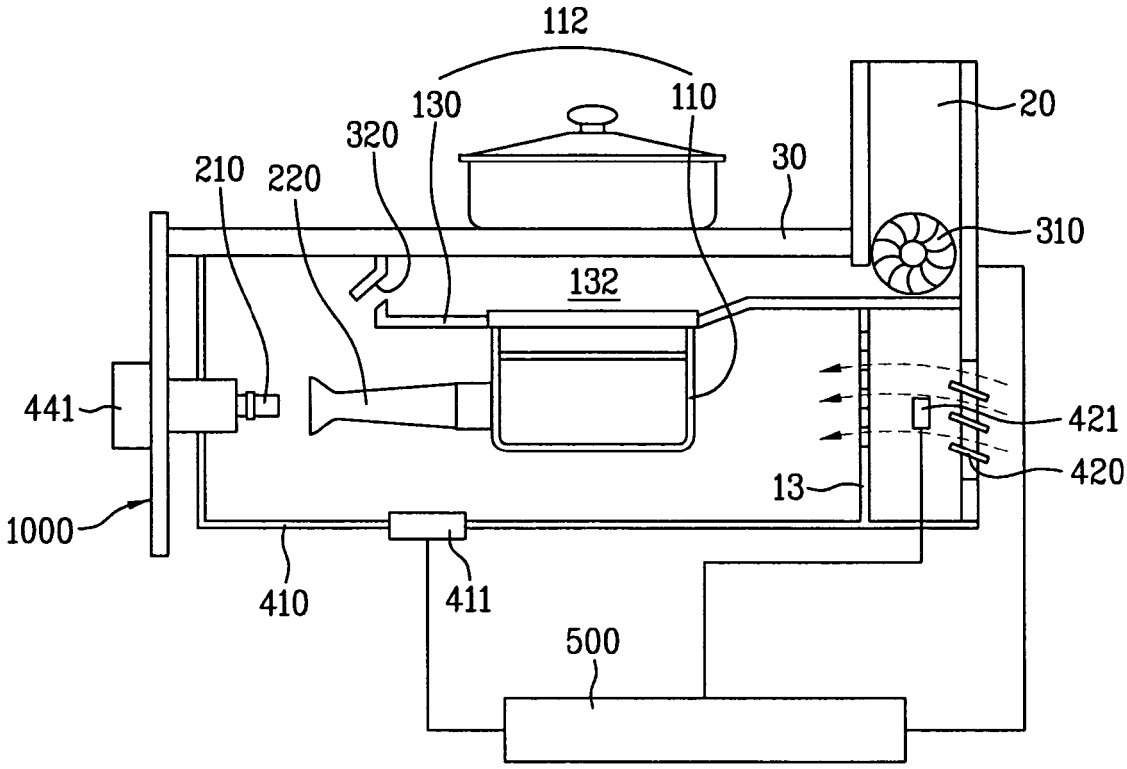
FIG. 3 is a cross-sectional diagram of the gas radiation burner shown in FIG. 2.
Figure 4:
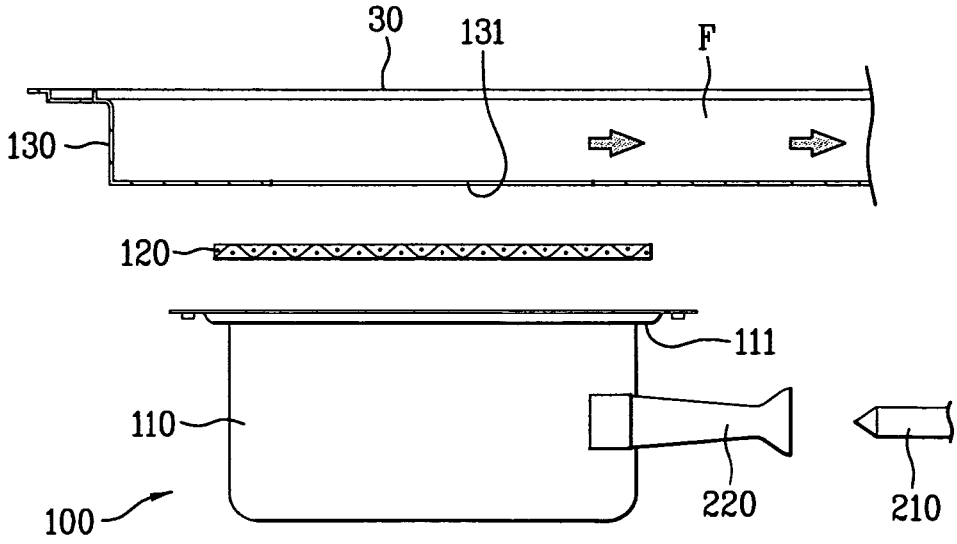
FIG. 4 is an exploded cross-sectional diagram of a burner body shown in FIG. 3.

FIG. 3 is a cross-sectional diagram of the gas radiation burner shown in FIG. 2, and FIG. 4 is an exploded cross-sectional diagram of a burner body shown in FIG. 3.

Referring to FIG. 3 and FIG. 4, a gas radiation burner 100 includes a gas supply unit spraying gas and air, a burner body 112 having a burner pot 110 accommodating a mixed gas sprayed from the gas supply unit and a burner housing 130 provided on the burner pot 110, a burner mat 120 heated by combustion of the air and gas fuel, and an air supply unit 320 supplying air to the burner housing 130.

The burner pot 110 has a cylindrical shape of which top is open. The gas supply unit supplying the air and gas is provided next to the burner pot 110. The burner pot 110 plays a role in providing a space for storing the air and the gas fuel for combustion and a space for mixing the air and the gas fuel together.

A mounting portion 111 is provided to an upper end portion of the burner pot 110. Optionally, a gasket (not shown in the drawings) can be provided on the burner mat 120 to adjust a surface area of the burner mat 120.

The burner housing 130 is provided on the burner pot 110 by pressing an edge of the burner mat 120. In addition, a circular opening 131 is provided to the burner housing 130 so that the radiant energy emitted from the burner mat 120 can pass therethrough. Therefore, the burner housing 130 plays a role in cutting off heat of the burner mat 120 not to be externally emitted and also plays a role in transferring the radiant heat of the burner mat 120 to the glass 30. A prescribed space is provided within the burner housing 130. The prescribed space enables the heat of the burner mat 120 to be delivered to the glass 30 in a radiant heat form and also plays a role as a passage for discharging an exhaust gas after combustion.

The burner mat 120 is provided to an upper end portion of the burner pot 110 and is formed of a material having a good thermal conductivity. The burner mat 120 includes a porous member enabling the gas fuel and air to pass therethrough. Therefore, the gas fuel is burnt on an upper surface of the burner mat 120. The burner mat 130 can be installed parallel with the burner housing 130. Alternatively, the burner mat 120 can be installed at a predetermined inclination. In addition, the burner mat 120 is coated with catalyst to lower an ignition point of the gas fuel. In particular, it can induce a quick ignition by lowering activation energy of the reaction between the air and the gas fuel using the catalyst. Moreover, an ignition device (not shown in the drawings) is provided next to the burner mat 120 to ignite the gas fuel mixed with the air.

The gas supply unit includes a mixing pipe 220 penetrating into an outer wall of the burner pot 110 and a nozzle 210 spraying the fuel gas into the mixing pipe 220. A plurality of gas supply units can be symmetrically provided to an outer circumference of the burner pot 110 to uniformly supply the air and the gas fuel into the burner pot 110. In the embodiments of the present invention, the gas supply unit is implemented in various ways, which will be explained later.

A tip of the mixing pipe 220 within the burner pot 110 is placed in a same plane of an inner wall of the burner pot 110. Alternatively, the tip of the mixing pipe 220 within the burner pot 110 can be installed to be projected from the inner wall of the burner pot 110 by a prescribed length.

Meanwhile, one side of the nozzle 210 is installed to be spaced apart from the mixing pipe 220 with a prescribed gap therein-between, whereas the other side is connected to a gas supply pipe 410 for supplying the gas fuel.

The gas fuel sprayed from the nozzle 210 is introduced into the mixing pipe 220. Since a flowing speed of the gas fuel introduced into the mixing pipe 220 is considerably high, a low pressure is formed around the gas fuel. Consequently, by a fluid pressure difference, the air in a static state is sucked into the mixing pipe.

A gas detecting member 411 is provided to the gas supply pipe 410 configuring a gas supply passage to measure a pressure of the gas fuel. In addition, the gas detecting member 411 is connected to the control unit 500 capable of controlling a quantity of the gas fuel supplied via the gas supply pipe 410.

Figure 5:
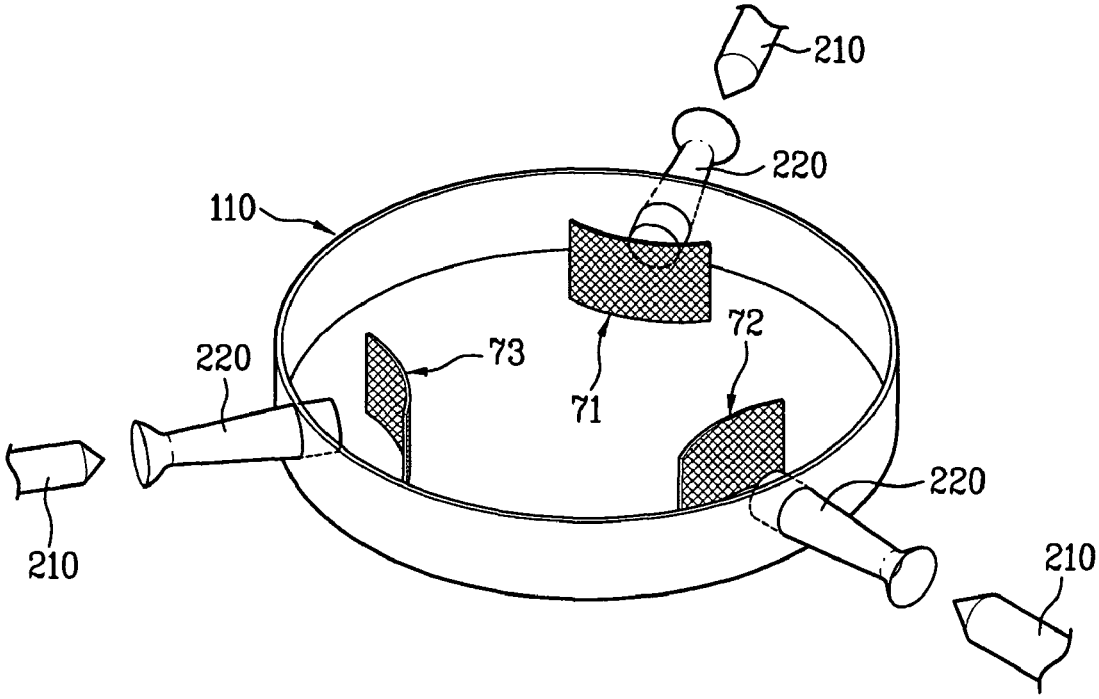
FIG. 5 is a perspective diagram of a gas supply unit according to a first embodiment in FIG. 3.

FIG. 5 is a perspective diagram of a gas supply unit according to a first embodiment in FIG. 3.

Referring to FIG. 5, a gas supply unit includes a mixing pipe 220 penetrating into an outer wall of a burner pot 110 and a nozzle 210 spraying a fuel into the mixing pipe 220.

The mixing pipes 220, as shown in FIG. 5, are distributed to the outer wall of the burner pot 110 to be spaced apart from each other by about 120 degrees. It should be noted that the number of the mixing pipes can be adjusted and is not limited to three (3) as shown in the illustrated embodiment. In this illustrated embodiment, the mixing pipes are symmetrically installed with a substantially equal distance. The air and gas fuel belching out of the three mixing pipes 220 are evenly distributed within the burner pot 110 to enable uniform surface combustion on a surface of a burner mat.

In this case, pressure recovering members 71, 72 and 73 are provided within the burner pot 110 to reduce the speed of gases introduced into the burner pot 110, respectively. In particular, each of the pressure recovering members 71, 72 and 73 reduces the speed of the gas fuel and air introduced into the burner pot 110 thereby reducing a dynamic pressure of the fluid but raising a static pressure thereof. Therefore, the gas fuel is not affected by the flowing speed, thereby implementing the uniform combustion on the surface of the burner mat 120.

Each of the pressure recovering members 71, 72 and 73 is provided to an exit side of the corresponding mixing pipe 220 with reference to a flowing direction of the gas fuel and air to be spaced apart from the corresponding mixing pipe 220. Optionally, each of the pressure receiving members 71, 72 and 73 can include a porous member having a plurality of holes therein.

Meanwhile, in viewing from a top of the burner body 112, the pressure receiving members 71, 72 and 73 are preferably provided outside the burner mat 120. This is to enable the gas fuel and air to be delivered to the burner mat 120 by reducing the flowing speed of the gas fuel and air. In addition, each of the pressure receiving members 71, 72 and 73 is curved to face the corresponding mixing pipe 220 so that the gas introduced into the burner pot 110 can be evenly spread within the burner pot 110. In particular, each of the pressure receiving members 71, 72 and 73 is bent convexly in a direction facing away from the corresponding mixing pipe 220. Optionally, each of the pressure receiving members 71, 72 and 73 is configured to have a slit shape to adjust a flowing direction of the gas fuel and air having passed through the corresponding mixing pipe 220.

Figure 6:
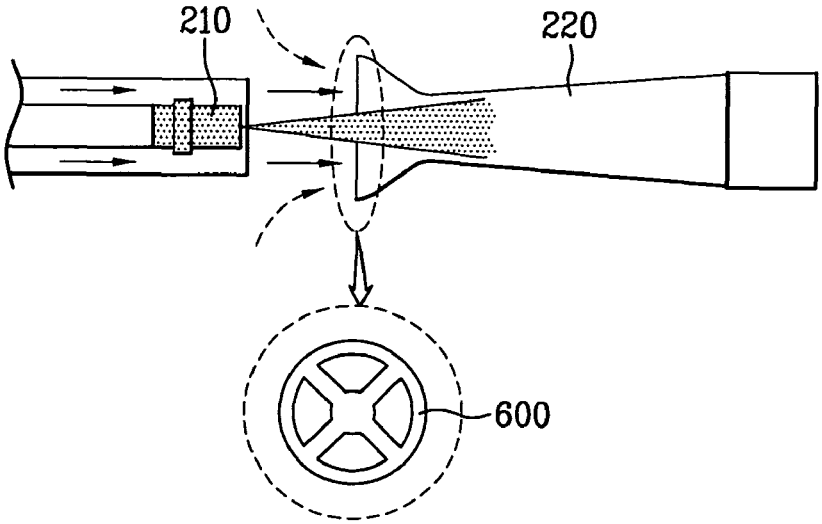
FIG. 6 is a cross-section diagram of an adjusting member to adjust a quantity of air introduced into a mixing pipe in FIG. 5.

FIG. 6 is a cross-section diagram of an adjusting member to adjust a quantity of air introduced into a mixing pipe in FIG. 5.

Referring to FIG. 6, an adjusting member includes a damper 600 adjusting a quantity of air introduced into the mixing pipe 220.

The damper 600 is provided to an entrance of the mixing pipe 220 to open/close the entrance of the mixing pipe 220 in part. Although not shown in the drawing, the damper 600 can be configured movable in upper/lower direction of the entrance of the mixing pipe 220 or rotatable in front of the entrance of the mixing pipe 220. A shape and open/close direction of the damper 600 can be configured in various ways. Consequently, the extent of opening/closing the entrance of the mixing pipe 220 depends on the shape of the damper 600 or a moving direction of the damper 600.

Optionally, the adjusting member is able to further include a louver 420 provided to the body 1000 shown in FIG. 3 to configure an opening/closing member and an air detecting member 421 measuring a pressure of air introduced into the body 1000 via the louver 420.

The air detecting member 421 is connected to the control unit 500. In addition, the control unit 500 controls an extent of opening/closing the louver 420 based on the air pressure measured by the air detecting member 421.

In particular, once an air quantity required for the combustion of the gas fuel is decided, the control unit 500 adjusts the opening/closing extent of the louver 420. The air introduced via the louver 420 passes through the air detecting member 421 into the air inlet 13. The air detecting member 421 measures a pressure of the introduced air and then transmits the measured air pressure to the control unit 500 again. The control unit 500 then decides whether the introduced air quantity is appropriate. If the introduced air quantity is not appropriate, the control unit 500 adjusts the louver 420 based on the air pressure transmitted by the air detecting member 421.

A gas detecting member 411 is provided to the gas supply pipe 410 to measure a pressure of the gas fuel. The gas detecting member 411 is connected to the control unit 500 capable of adjusting a quantity of the gas fuel supplied via the gas supply pipe 410.

Figure 7:
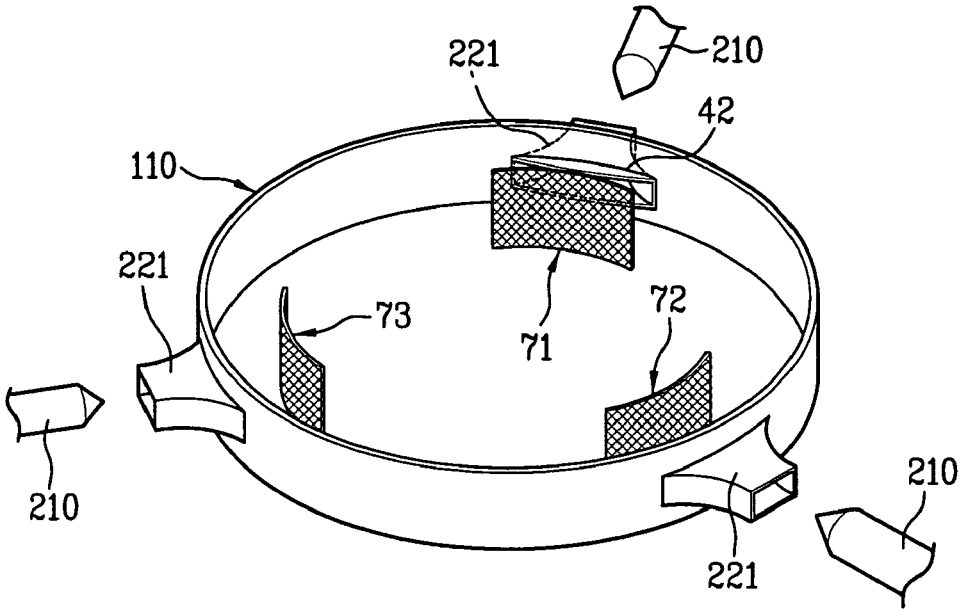
FIG. 7 is a perspective diagram of a gas supply unit according to a second embodiment in FIG. 3.

FIG. 7 is a perspective diagram of a gas supply unit according to a second embodiment in FIG. 3.

Referring to FIG. 7, compared to the embodiment shown in FIG. 5, the second embodiment differs in a configuration of a mixing pipe. The differences are explained hereinbelow.

First of all, a mixing pipe 221 of the present embodiment has an expanding pipe type tube shape of which width extends wider toward an inside of the burner pot 110. Preferably, the mixing pipe 221 has a thin and wide width to enable the air and gas fuel to spread wider into the burner pot 110. The gas fuel introduced into the mixing pipe 221 is supplied via a nozzle 210.

In viewing the burner body 112 from its topside, extension lines or curves of exit angles of three mixing pipes 221 for belching out the gas fuel and air can be configured to enclose an entire cross-section of the burner pot 110.

Thus, if the extension lines of the exit angles of the mixing pipes 221 are configured to enclose the entire cross-section of the burner pot 110, a mixed gas supplied from each of the mixing pipes 221 can be uniformly supplied to the burner pot 110. Hence, it may prevent the mixed gas from unevenly existing within the burner pot 110. Alternatively, in viewing the burner body 112 from its topside, the extensions lines of the exit angles can be configured to enclose the burner mat entirely.

Figure 8:
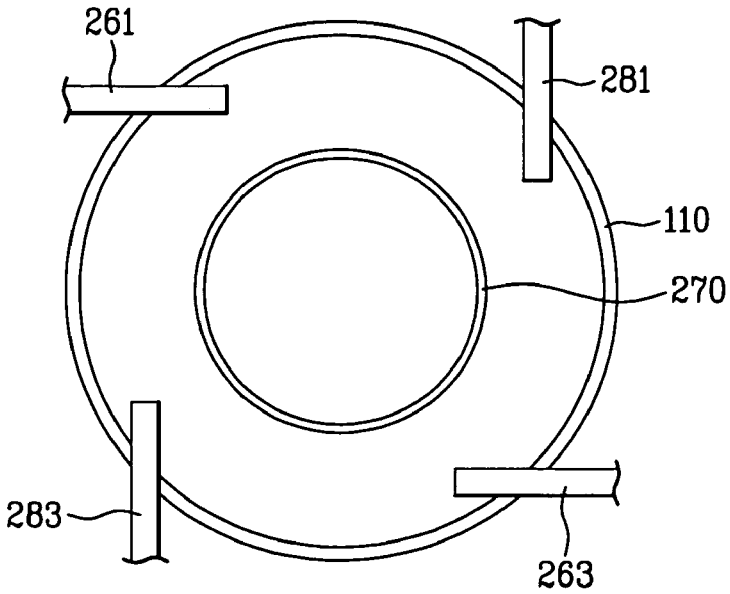
FIG. 8 is a perspective diagram of a gas supply unit according to a third embodiment in FIG. 3.

FIG. 8 is a perspective diagram of a gas supply unit according to a third embodiment in FIG. 3.

Referring to FIG. 8, unlike the former embodiments, a gas supply unit according to a third embodiment includes at least one or more air supply pipes 261 and 263 for supplying air only and at least one or more gas supply pipes 281 and 283 for supplying gas fuel only.

Each of the air supply pipes 261 and 263 supplies the air within the burner pot 110, whereas each of the gas supply pipes 281 and 283 supplies the gas fuel within the burner pot 110. In particular, the air and the gas fuel are introduced in the burner pot 110 via individual paths, respectively, and are then mixed together.

In this case, the air supply pipes 261 and 263 and the gas supply pipes 281 and 283 are alternately provided along an outer circumference of the burner pot 110. The air and the gas fuel belching out of the air supply pipes 261 and 263 and the gas supply pipes 281 and 283 are blown in a same rotational direction, e.g., clockwise, instead of being blown in opposite directions, respectively.

The air supply pipes 261 and 263 and the gas supply pipes 281 and 283 are installed so that the supplied air and gas fuel can flow along an inner circumference of the gas pot 110. In particular, the air supply pipes 261 and 263 and the gas supply pipes 281 and 283, as shown in FIG. 8, are installed in a direction tangential to the burner pot 110. Therefore, the air and gas fuel belching out of the air supply pipes 261 and 263 and the gas supply pipes 281 and 283 turn along the inner circumference of the burner pot 110 in the same direction, e.g., clockwise, and are mixed with each other.

A pressure recovering member 270 is provided within the burner pot 110 to reduce a speed of gas introduced into the burner pot 110. The pressure recovering member 270 substantially has a circular ring shape and is provided to a center of the burner pot 110. Preferably, viewing from the topside of the burner body 112, the pressure recovering member 270 is located outside the burner mat 120. This is to enable the gas fuel and air to be delivered to the burner mat while flowing speeds of the gas fuel and air are reduced. Alternatively, the pressure recovering member 270 can be provided in front of the gas supply pipe for belching the gas fuel or the air supply pipe for belching the air.

Figure 9:
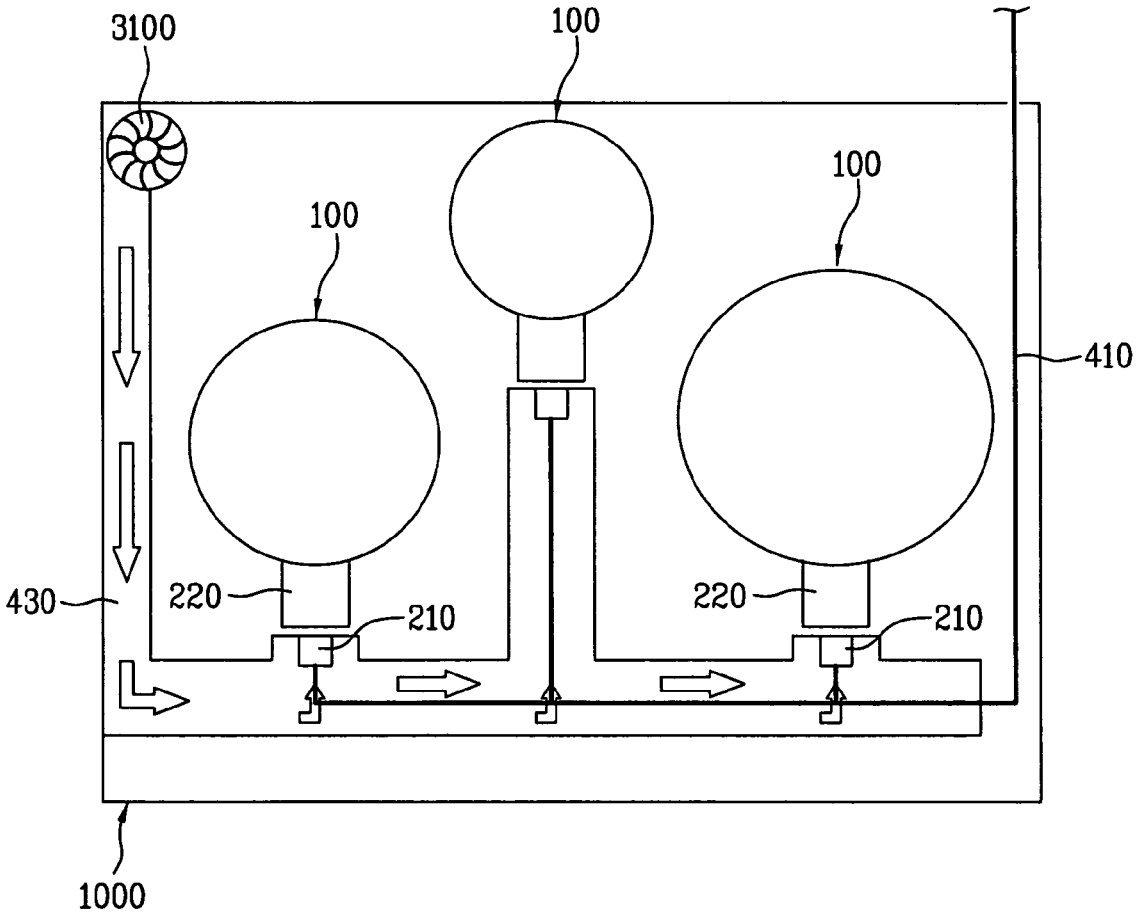
FIG. 9 is a layout of a gas supply unit according to a fourth embodiment in FIG. 3.

FIG. 9 is a layout of a gas supply unit according to a fourth embodiment in FIG. 3.

Referring to FIG. 9, a fourth embodiment differs from the former embodiments in including a blowing fan 3100 forcibly blowing air into the burner body 112. The differences are disclosed hereinbelow.

First of all, a gas radiation burner according to a fourth embodiment of the present invention includes an air supply pipe 430 configuring an air supply passage for supplying air and a gas supply pipe 410 configuring a gas supply passage for supplying a gas fuel.

The air supply pipe 430 communicates with an external environment, whereas the gas supply pipe 410 is connected to a gas supply source (not shown in the drawing) provided outside the gas radiation burner.

A nozzle 210 is provided to one end portion of the gas supply pipe 410 to spray the gas fuel. The nozzle 210 is spaced apart from the mixing pipe 220 of the burner pot 110 by a prescribed gap and is installed at the air supply pipe 430.

Therefore, if the gas fuel is sprayed into the mixing pipe 220 from the nozzle 210, an air around the gas fuel is sucked into the mixing pipe 220. This is explained in detail in the above description and will not be repeated here.

Meanwhile, the blowing fan 3100 provided to one end of the air supply pipe 430 forces an external air to be sucked into the air supply pipe 430. If so, the air sucked into the air supply pipe 430 is forced to be introduced into the burner body 112.

The blowing fan 3100 is controlled by the control unit 500 (as shown in FIG. 3) provided to the gas radiation burner. In addition, an RPM of the blowing fan 3100 is varied according to a heat quantity required for the gas radiation burner. The RPM of the blowing fan 3100 in case of gas fuel combustion in one body burner is lower than that in case of gas fuel combustion in a plurality of burner bodies. This is because the total air quantity required for a plurality of the burner bodies is greater than the air quantity required for one burner body.

A damper (not shown in FIG. 9) can be provided to the air supply pipe 430 to control the air quantity supplied to the corresponding burner body 112. The damper is driven by a driving device (not shown in the drawing) provided to the gas radiation burner. In addition, the driving device is controlled by the control unit 500.

Figure 10:
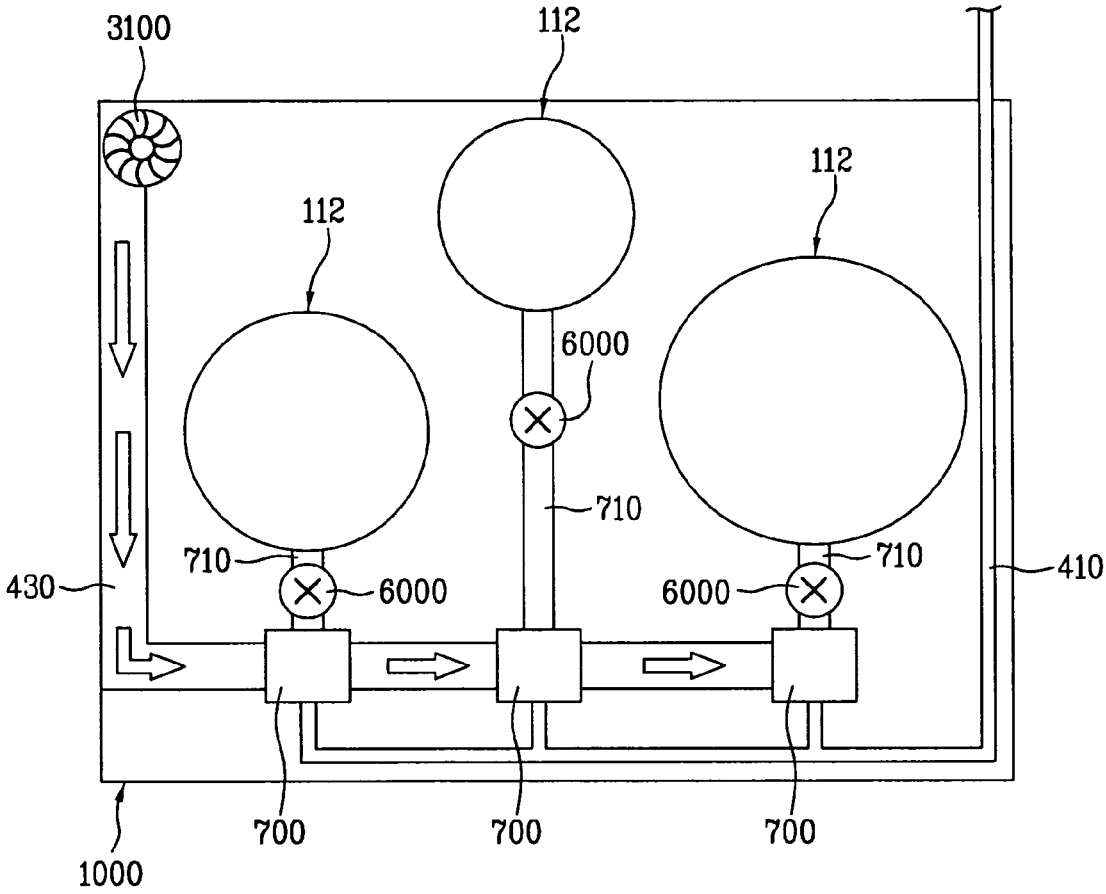
FIG. 10 is a layout of a gas supply unit according to a fifth embodiment in FIG. 3.
Figure 11:
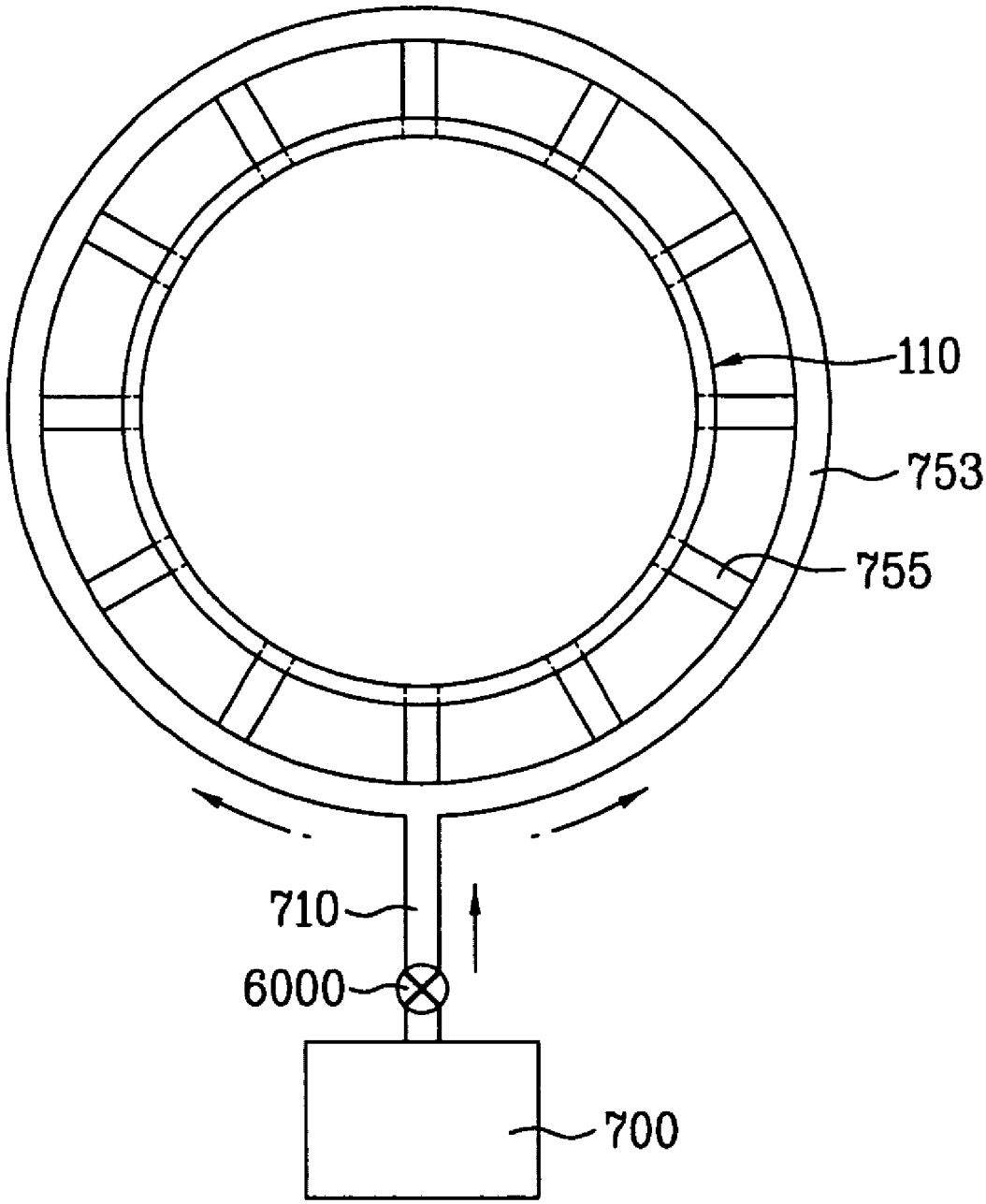
FIG. 11 illustrates one embodiment for supplying a mixed gas to a burner pot from a mixing chamber in FIG. 10.

FIG. 10 is a layout of a gas supply unit according to a fifth embodiment in FIG. 3, and FIG. 11 illustrates one embodiment for supplying a mixed gas to a burner pot from a mixing chamber in FIG. 10.

Referring to FIG. 10 and FIG. 11, a fifth embodiment of the present invention differs from the former embodiments in that the air and gas fuel are preferentially mixed together before entering the burner body 112.

In particular, a gas supply unit supplying the air and gas fuel into a the burner body includes a mixing chamber 700 providing a space for mixing the gas fuel and air together and a mixed gas supply pipe supplying the mixed gas fuel and air into the burner pot 110.

In addition, the gas supply unit according to the fifth embodiment of the present invention includes an air supply pipe 430 configuring an air supply passage for supplying the air into the mixing chamber 700 and a gas supply pipe 410 configuring a gas supply passage for supplying the gas fuel.

Moreover, the gas supply unit according to the fifth embodiment of the present invention includes an adjusting device controlling a quantity of the gas introduced into the burner body. The adjusting device includes a flux control valve 6000 controlling a flux of the gas belching from the mixing chamber 700. In this case, the flux control valve 6000 is provided on a first supply pipe 710 that connects the mixing chamber 700 and each of the burner bodies 112.

In particular, the control unit 500 (as shown in FIG. 3) of the present embodiment adjusts a quantity of the gas introduced into the mixing chamber 700 by controlling the flux control valve 6000 according to a heat quantity requested by the corresponding burner body 112. In this case, the flux control valve 6000 includes a solenoid valve. Alternatively, any valve capable of turning on/off the first supply pipe 710 can be used as the flux control valve 6000.

Meanwhile, the adjusting device can further include a blowing fan 3100 forcing the air to flow into the mixing chamber 700. Preferably, the blowing fan 3100 has an RPM variable according to a heat quantity requested by the burner body.

The mixing gas supply pipe includes the first supply pipe 710 directly connected to the mixing chamber 700, a second supply pipe 753 enclosing an outer circumference of the burner pot 110, and at least one connecting pipe 755 connecting the burner pot 110 and the second supply pipe 753 together.

The mixing chamber 700 is connected to the gas supply pipe 410 (as shown in FIG. 10) supplying the gas fuel and the air supply pipe 430 (as shown in FIG. 10) supplying the air. The mixing chamber 700 is connected to the first supply pipe 710 from which the mixed gas fuel belches, and the first supply pipe 710 is connected to the second supply pipe 753. The second supply pipe 753 communicates with one side of the connecting pipe 755. In addition, the other side of the connecting pipe 755 communicates with an inside of the burner pot 110.

Hence, the air supplied via the air supply pipe and the gas fuel supplied from the gas supply pipe meet each other and are mixed together within the mixing chamber 700. The mixed air and gas fuel belch out of the mixing chamber 700 via the first supply pipe 710. The air and gas fuel having belched out of the mixing chamber 700 moves to the outer circumference of the burner pot 110 along the second supply pipe 753. The air and gas fuel are then introduced into the burner pot 110 via the connecting pipe 755 diverging from the second supply pipe 753.

The connecting pipe 755 is configured symmetric on the outer circumference of the burner pot 110. In the illustrated embodiment, the connecting pipes 755 are located in a radial direction of the circumference of the burner pot 110. This is to uniformly supply the air and gas fuel into the burner pot 110. A length of the connecting pipe 755 in the radial direction of the circumference of the burner pot 110 may vary according to a position where the connecting pipe is provided. This is because a pressure of the air and gas fuel injected into the burner pot 110 via the connecting pipe 755 varies if a distance between the connecting pipe 755 and the mixing chamber 700 increases. Hence, by increasing the length of the connecting pipe 755 closer to the mixing chamber 700 and decreasing the length of the connecting pipe 755 relatively farther from the mixing chamber 700, the air and gas fuel can be uniformly introduced into the burner pot 110.

A process for supplying the air and gas fuel in the above-configured gas radiation burner is explained as follows.

First of all, the air supplied from the air supply pipe 430 and the gas fuel supplied from the gas supply pipe 410 meet each other in the mixing chamber 700 and are then mixed together therein. The blowing fan 3100 supplies an appropriate amount of air suitable for a heat quantity requested by the burner body 112. In particular, the blowing fan 3100 is controlled by the control unit 500 and varies its RPM according to the quantity of the supplied air. Consequently, it can prevent the shortage of the air quantity which is caused by the compactness of the burner body.

Subsequently, the mixed air and gas fuel are introduced into the burner body 112 via the flux control valve 6000. In this case, the flux control valve 6000 adjusts a quantity of the gas introduced into the burner body according to the requested heat quantity.

Referring to FIG. 3, the air supply unit is provided to the burner body to supply the air directly into the burner housing 130. The air supply unit includes an air supply member 320 configuring a path for directly sucking the air into the burner housing 130 and a blowing fan 310 forcing the air to flow into the burner housing 130.

The air supply member 320 is provided to next to the burner housing 130 and plays a role in connecting an inside of the burner housing 130 to an inside of the body 1000. The air supply member 320 can be configured in a shape of a housing hole provided to an outer wall of the burner housing 130. A hole guide can be provided to a rim of the housing hole to smoothen an air flow.

The blowing fan 310 is provided on the exhaust duct 20 for discharging an exhaust gas produced from the combustion of the gas fuel. Therefore, once the blowing fan 310 is activated, the air within the body 1000 is introduced into the burner housing 130 via the air supply member 320. Since the exhaust duct 20 communicates with the burner housing 130, the exhaust gas remaining within the burner housing 130 can be discharged via the exhaust duct 20.

The air supply unit is able to keep supplying a predetermined quantity of air into the burner body 1000 or supply the air into the burner body before or after the combustion of the gas fuel.

In the gas radiation burner provided with a plurality of the burner bodies 112, each of the burner bodies 112 operates independently. In addition, the exhaust gas produced from the combustion of each of the burner bodies 112 can be discharged via each exhaust duct. Alternatively, even if each of the burner bodies operates independently, the burner bodies can be connected to one exhaust duct 20.

Figure 12:
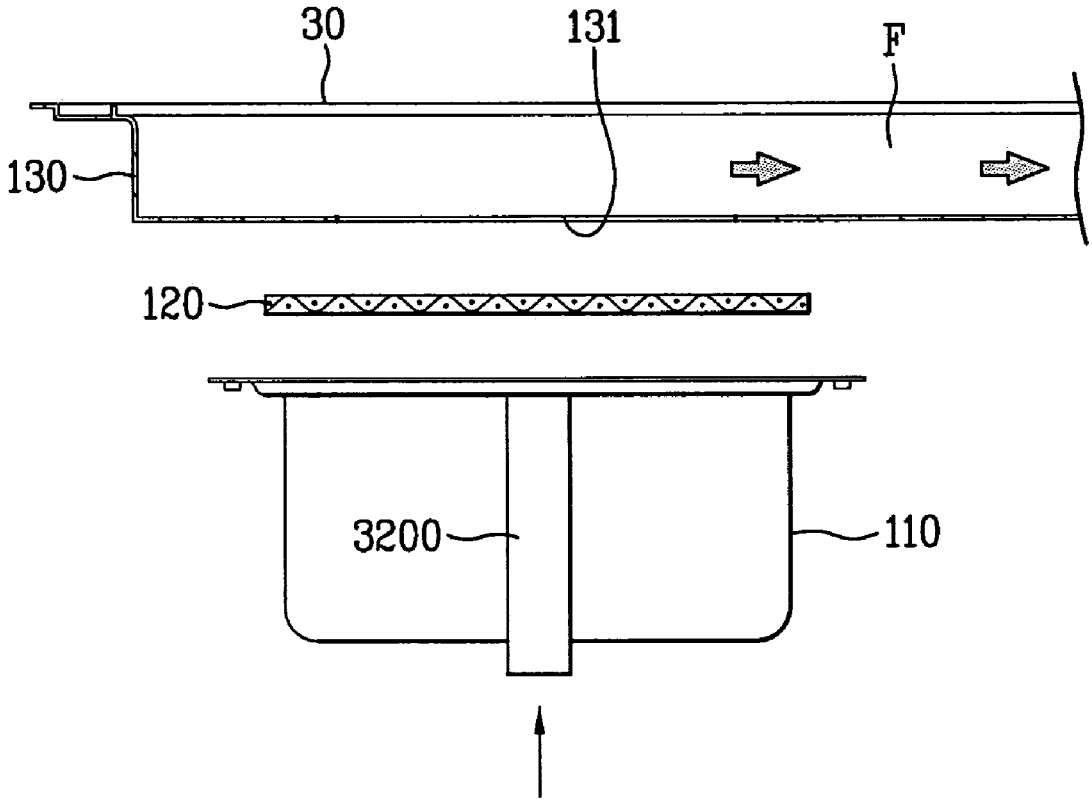
FIG. 12 is a cross-sectional diagram of an air supply unit in FIG. 3 according to another embodiment of the present invention.

FIG. 12 is a cross-sectional diagram of an air supply unit in FIG. 3 according to another embodiment of the present invention.

Referring to FIG. 12, an air supply member configuring an air supply unit of the present embodiment differs from the former embodiment in configurations. In addition, the differences are described hereinbelow.

First of all, an air supply member 3200 of the present embodiment is a pipe member and installed to penetrate into the burner pot 110.

In particular, one end of the air supply member 3200 communicates with a bottom of the burner housing 130, whereas the other end communicates with an air supply pipe (not shown in the drawing) configuring an air supply passage separately provided within the body. Hence, the air supply member 3200 is configured not to communicate with the burner pot 110.

Alternatively, the air supply member 3200 can be directly provided next to the burner housing 130 but not to penetrate the burner pot 110.

An auxiliary blowing fan (not shown in the drawing) forcing the air to be introduced into the air supply member 3200 can be provided to an end portion of the air supply passage. Therefore, only if additional air needs to be supplied into the burner housing 130, will the auxiliary blowing fan be activated to directly supply the air into the burner housing 130. Whether to supply the air via the air supply member 3200 can be decided according to a user's selection.

For instance, the air via the air supply member 3200 can be supplied for the better combustion of the gas fuel while the combustion of the gas fuel is progressing. Alternatively, the air can be supplied before the combustion of the gas fuel is initiated or after the combustion of the gas fuel has been completed.

If the air is supplied to the burner housing 130 using the air supply unit in the course of the combustion of the gas fuel, it can solve the problem of air shortage attributed to the compactness of the burner body. Hence, the better combustion of the fuel gas can be implemented by supplying sufficient air to the burner body according to the requested heat quantity, thereby enhancing combustion efficiency.

If the air supply unit supplies the air into the burner housing 130 before the combustion of the gas fuel, the gas fuel and exhaust gas remaining within the burner housing 130 are discharged from the burner housing 130. Hence, it can prevent the explosive ignition due to the remaining gas in igniting the gas fuel to active the gas radiation burner.

If the air supply unit supplies the air into the burner housing 130 after the combustion of the gas fuel, a temperature of the glass 30 on the burner housing 130 is lowered. In particular, the air introduced from outside via the air supply member 320 cools down the burner housing 130, the glass 30, the burner mat 120, and the like to consequently prevent the overheating of the heated object. Besides, it is able to efficiently discharge the exhaust gas remaining within the burner housing 130.

An operational process of the above-configured burner system is explained as follows.

First of all, if a user activates the gas radiation burner, the control unit 500 supplies an air only into the burner housing 130 by driving the blowing fan 310 before a gas fuel is supplied to the burner pot 110. After a prescribed time passes by, the control unit 500 simultaneously supplies the air and the gas fuel into the burner body 112. The gas fuel introduced into the burner pot 110 is then ignited by the ignition means (not shown in the drawings) provided next to the burner mat 120.

By the combustion of the gas fuel, the burner mat 120 is heated and simultaneously emits radiant heat. Heat transfer takes place on a surface of the burner mat 120 due to the convection current. The heat of the burner mat 120 is transferred to the glass 30 provided on the burner housing 130 to heat the glass 30. The glass 30 then heats up an object thereabove at a prescribed temperature.

An exhaust gas produced from the combustion of the gas fuel passes through the space 132 provided between the glass 30 and the burner housing 130 and is then externally discharged via the exhaust duct 20. After completion of the combustion of the gas fuel, the supply of the gas fuel is stopped but an air is supplied into the burner housing 130 by the air supply unit only.

The air supplied into the burner housing 130 by the air supply unit cools down the burner housing 130, the glass 30, the burner mat 120, and the like and simultaneously discharges the remaining exhaust gas from the burner housing 130.

Accordingly, the illustrated embodiments provide the following effects or advantages.

First of all, the adjusting member controls the air quantity introduced into the burner pot, thereby supplying the air sufficient to meet the requested heat quantity into the burner chamber. In addition, the better combustion of the gas fuel is implemented by supplying sufficient air to the burner body, thereby raising combustion efficiency and reducing the exhaust gas.

Secondly, the air supply unit capable of supplies the air into the burner housing directly, thereby preventing an explosive ignition before the combustion of the gas fuel and cooling down the burner system after the combustion of the gas fuel.

Thirdly, the blowing fan on the exhaust duct discharges the remaining exhaust gas from a plurality of the burner bodes via one exhaust duct, thereby reducing a flowing load.

Fourthly, the mixing chamber can mix the air and gas fuel introduced into the burner pot in advance to implement the better combustion of the gas fuel, thereby raising combustion efficiency.

Fifthly, the mixed gas of the gas fuel and air is supplied into the burner pot using the expanding tube type mixing pipe, thereby implementing uniform surface combustion on the surface of the burner mat. Hence, combustion efficiency is enhanced and the exhaust gas is reduced after combustion.

Sixthly, a plurality of the air supply units may be installed symmetric to supply the air and gas fuel sufficiently into the burner pot, thereby increasing a heat quantity for use and reducing a time taken to heat an object.

Finally, the pressure recovering members within the burner pot can reduce the speed of the air and gas fuel introduced into the burner pot, thereby implementing the uniform surface combustion on the surface of the burner mat.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A gas radiation burner comprising:

a plurality of gas supply units for spraying a mixed gas of a gas and air, wherein each of the gas supply units comprises at least one mixing pipe;

a burner body having a burner pot accommodating the mixed gas supplied by the gas supply units and a burner housing provided on the burner pot to configure a combustion chamber;

a burner mat provided over the burner pot to emit a radiant heat generated by combustion of the mixed gas supplied by the burner pot; and an air supply unit supplying air to the burner housing, a pressure recovering member configured to reduce a speed of the mixed gas sprayed by the mixing pipe, wherein the pressure recovering member is located at an exit end of the mixing pipe and is spaced apart from the mixing pipe, wherein the gas supply units uniformly provide the mixed gas into the burner pot, and are symmetrically installed to the burner pot so that the mixed gas is evenly distributed into the burner pot, and wherein each of the gas supply units further comprises:

an air detecting member at an air supply passage for supplying the air into the gas radiation burner to detect a pressure of the supplied air;

an opening/closing member for opening/closing the air supply passage; and a control unit controlling the opening/closing member to selectively open or close the opening/closing member according to the pressure of the supplied air detected by the air detecting member.

2. The gas radiation burner of claim 1, wherein each of the gas supply units further comprises:

a gas supply member spraying the gas, wherein the at least one mixing pipe forms the mixed gas by sucking air surrounding the mixing pipe together with the gas sprayed by the gas supply member, the mixing pipe spraying the mixed gas into the burner pot.

3. The gas radiation burner of claim 2, wherein the mixing pipe has an expanding tube shape, the expanding tube shape being wider as the mixing pipe extends toward the burner pot.

4. The gas radiation burner of claim 3, wherein each of the gas supply units includes a plurality of mixing pipes, extension lines extending from an exit end of the mixing pipes enclosing an entire cross-section of the burner pot.

5. The gas radiation burner of claim 2, wherein each of the gas supply units further comprises an adjusting member at an inlet of the mixing pipe to adjust a quantity of the air introduced into the mixing pipe.

6. The gas radiation burner of claim 1, wherein the pressure recovering member is located outside the burner mat.

7. The gas radiation burner of claim 1, further comprising a gas detecting member at a gas supply passage for supplying the gas to a corresponding one of the gas supply units to detect a pressure of the supplied gas, wherein the control unit controls a quantity of the gas supplied along the gas supply passage according to the pressure of the supplied gas detected by the gas detecting member.

8. The gas radiation burner of claim 1, wherein each of the gas supply units comprises:

at least one air supply pipe for supplying the air to the burner pot; and at least one gas supply pipe for supplying the gas to the burner pot.

9. The gas radiation burner of claim 8, wherein each of the gas supply units comprises a plurality of air supply pipes and a plurality of gas supply pipes, the air supply pipes and the gas supply pipes being alternately provided along an outer circumference of the burner pot.

10. The gas radiation burner of claim 9, wherein the air supply pipes and the gas supply pipes are installed such that the supplied air and gas flow along an inner circumference of the burner pot.

11. The gas radiation burner of claim 10, wherein each of the air supply pipes and the gas supply pipes is substantially parallel to a direction tangential to the burner pot, the immediately adjacent air supply pipe and gas supply pipe being perpendicular.

12. The gas radiation burner of claim 1, wherein each of the gas supply units further comprises a fan on an air supply passage for supplying the air.

13. The gas radiation burner of claim 12, wherein an RPM (revolution per minute) of the fan is variable.

14. The gas radiation burner of claim 1, wherein each of the gas supply units comprises: a mixing chamber connected to an air supply passage for supplying the air and a gas supply passage for supplying the gas, the mixing chamber forming the mixed gas of the air and the gas, the mixing chamber supplying the mixed gas to the burner pot.

15. The gas radiation burner of claim 14, further comprising a control valve for adjusting a quantity of the mixed gas supplied by the mixing chamber.

16. The gas radiation burner of claim 14, further comprising:

a first supply pipe connected to the mixing chamber;

a second supply pipe connected to the first supply pipe to enclose the burner pot; and at least one connecting pipe connecting the second supply pipe and the burner pot.

17. The gas radiation burner of claim 16, wherein there are a plurality of connecting pipes symmetrically located along an outer circumference of the burner pot and have at least two different lengths.

18. The gas radiation burner of claim 17, wherein the length of the corresponding connecting pipe increases when the corresponding connecting pipe is closer to the mixing chamber.

19. The gas radiation burner of claim 1, wherein the air supply unit comprises:

an air supply member communicating with an external environment of the housing to suck the air therein; and a fan provided to an exhaust duct for discharging an exhaust gas from the housing.

20. The gas radiation burner of claim 19, wherein the air supply member is connected to a bottom of the housing.

21. The gas radiation burner of claim 20, wherein the air supply member penetrates through the burner pot and the air in the air supply member does not to communicate with the burner pot.

* * * * *